US006780042B1

(12) United States Patent
Badescu et al.

(10) Patent No.: US 6,780,042 B1
(45) Date of Patent: Aug. 24, 2004

(54) ACTIVE QUICK CONNECTING/ DISCONNECTING CONNECTOR

(75) Inventors: Mircea Badescu, North Plainfield, NJ (US); Constantinos Mavroidis, Somerset, NJ (US)

(73) Assignee: Rutgers, The State University of New Jersey, New Brunswick, NJ (US)

( * ) Notice: Subject to any disclaimer, the term of this patent is extended or adjusted under 35 U.S.C. 154(b) by 0 days.

(21) Appl. No.: 10/343,686

(22) PCT Filed: Aug. 3, 2000

(86) PCT No.: PCT/US00/21250

§ 371 (c)(1),
(2), (4) Date: May 13, 2003

(87) PCT Pub. No.: WO02/13326

PCT Pub. Date: Feb. 14, 2002

(51) Int. Cl.[7] ..... H01R 13/627
(52) U.S. Cl. ..... 439/352
(58) Field of Search ..... 439/352, 353, 439/357, 675, 851, 161; 285/23, 308; 173/363

(56) References Cited

U.S. PATENT DOCUMENTS

| | | | | | |
|---|---|---|---|---|---|
| 2,502,302 | A | | 3/1950 | Arson | 173/363 |
| 3,336,563 | A | * | 8/1967 | Hyslop | 439/603 |
| 4,284,313 | A | | 8/1981 | Anhalt | 339/61 |
| 5,160,233 | A | | 11/1992 | McKinnis | 411/433 |
| 5,336,254 | A | | 8/1994 | Brennen et al. | 607/129 |
| 5,366,254 | A | | 11/1994 | Tucchio et al. | 285/23 |
| 5,389,007 | A | | 2/1995 | Reinelt | 439/357 |
| 5,611,707 | A | | 3/1997 | Meynier | 439/353 |
| 5,676,405 | A | | 10/1997 | Reed | 285/315 |
| 5,730,472 | A | | 3/1998 | Krause et al. | 285/21.1 |
| 5,836,781 | A | | 11/1998 | Hyzin | 439/348 |
| 5,897,142 | A | | 4/1999 | Kulevsky | 285/308 |
| 5,941,577 | A | | 8/1999 | Musellec | 285/317 |
| 5,992,903 | A | | 11/1999 | Bartholomew | 285/319 |
| 6,012,944 | A | | 1/2000 | Hatakeyama | 439/441 |
| 6,093,043 | A | * | 7/2000 | Gray et al. | 439/352 |
| 6,364,675 | B1 | * | 4/2002 | Brauer et al. | 439/159 |
| 6,525,808 | B1 | * | 2/2003 | Jackson et al. | 356/128 |

* cited by examiner

*Primary Examiner*—P. Austin Bradley
*Assistant Examiner*—Phuongchi Nguyen
(74) *Attorney, Agent, or Firm*—Wolff & Samson PC

(57) ABSTRACT

A connector is provided for the electrical and mechanical connection of components of a system. The connector includes plug and receptacle components. The plug has a central pin surrounded by a plurality of lamellae. An actuator is positioned about the lamellae for controlling the movement thereof. The receptacle has a pin housing corresponding to the central pin of the plug. Additionally, the receptacle includes a plurality of lamellae for mating with the plug lamellae. Like the plug, the receptacle includes an actuator for controlling movement of the receptacle lamellae. The plug lamellae and the receptacle lamellae have corresponding shoulders at the free ends thereof for engagement for interconnecting the plug and the receptacle. The actuators about the plug lamellae and receptacle lamellae control movement thereof and can be engaged to allow for the disconnection of the plug and the receptacle. The central trail pin of the plug and the pin housing of the receptacle can include conductive material for transmitting electrical signals. Similarly, the lamellae can include conductive materials for engagement and transmission of electric signals. In another embodiment, the plug and receptacle are positioned side by side to provide a universal connector.

32 Claims, 7 Drawing Sheets

ACTIVE QUICK CONNECTING/ DISCONNECTING CONNECTOR

BACKGROUND OF THE INVENTION

1. Field of the Invention

The present invention relates to a connector for mechanically and/or electrically connecting two objects together, and more particularly to such a connector that can be used for connecting modules of a modular robotics or electromechanical system.

2. Related Art

Connectors are important for connecting objects together. In many cases, it is desirable for a connector to provide for mechanical and/or electrical connection between two objects. Often times, it is additionally desirable to be able to quickly and easily make a connection, and to quickly and easily disconnect the connector.

One particular area of application for such connectors is modular robotic and electromecanical systems. Generally, modular systems employ modules that can be connected and disconnected and rearranged in different configurations to form different systems. Modular robot or electromecanical systems are particularly suited to deployment in planetary exploration tasks because they are lightweight, efficient, powerful and can be reconfigured in a large number of different configurations from a small number of modules. Other areas of application include connecting electrical conductors having two or more electrical lines; and connecting pipes that transport fluids.

Important features for the connection of system modules is the ability to connect modules together without the need for exact alignment between connectors; connectors that have suitable mechanical properties to maintain connection between modules; connectors that can additionally transmit electric signals therethrough; and connectors that can be quickly and easily disconnected. A limiting feature of modular systems is the use of male and female connectors, Past efforts in the area to provide suitable connectors for modular robots have generally lacked one or more of the desired characteristics previously set forth. Accordingly, what is needed, but has not yet been developed, is a connector that can quickly and easily, electrically and mechanically connect two objects together, which can be quickly and easily disconnected and which has universal connectability.

Other efforts to provide connectors include: U.S. Pat. No. 4,284,313 to Anhalt; U.S. Pat. No. 5,160,233 to McKinnis; U.S. Pat. No. 5,336,254 to Brennen. et a.; U.S. Pat. No. 5,366,254 to Tucchio. et al.; U.S. Pat. No. 5,676,405 to Reed; U.S. Pat. No. 5,730,472 to Krause, et al.; U.S. Pat. No. 5,836,781 to Hyzin; U.S. Pat. No. 5,897,142 to Kulevsky; U.S. Pat. No. 5,992,903 to Bartholomew; and PCT Application No. PCT/FR96/01728 to Musellec. However, none of these other efforts disclose all of the benefits of the present invention, nor do they show all of the elements of the present invention.

OBJECTS AND SUMMARY OF THE INVENTION

It is an object of the present invention to provide a connector for mechanically and/or electrically interconnecting two objects.

It is an additional object of the present invention to provide connectors for connecting two objects wherein a connection can be made without the need for exact alignment of the connector components.

It is an additional object of the present invention to provide connectors for connecting two objects together which can be quickly and easily disconnected.

It is still even an additional object of the present invention to provide a connector which requires electrical or mechanical intervention for permitting disconnection.

It is a further object of the present invention to provide a connector that can transfer axial, shear and/or torque forces.

It is another object of the present invention to provide a connector which requires a disconnecting signal prior to disconnection, wherein the disconnecting signal can come from the plug and/or receptacle side of the connector.

It is an additional object of the present invention to provide a connector which can be disconnected by mechanical means located at either the plug or receptacle side of the connector.

It is a farther object of the present invention to provide a connector which can be operated by a human, or automatically by a robot or computer controlled electromechanical systems.

It is still a further object of the present invention to provide a connector that can be connected by a simple robot system having a simple gripper for gripping the connector.

It is even a further object of the present invention to provide a connector that can be made to swivel instead of transmitting torque.

It is still an additional object of the present invention to provide a universal connector to eliminate the problems associated with male and female connectors.

It is still yet an additional object of the present invention to provide a universal connector having both male and female components located side by side for attaching to any other connector having male and female components located side by side.

It is even a further object of the present invention to provide a connector wherein the connector includes a latching mechanism.

It is even a further object of the present invention to provide a connector wherein the connector has a low insertion force.

It is even a further object of the present invention to provide a connector wherein the connection is blind mate and does not require exact alignment between components.

It is even a further object of the present invention to provide a connector which can be automatically disconnected.

It is even a further object of the present invention to provide a connector which can be self latching.

It is even a further object of the present invention to provide a connector to provide a connector which has an application in the robotic, computer, aerospace and space industries.

The present invention relates to a connector for the electrical connection of conductors, and the mechanical connection of mechanical components of a system and/or any other object that requires mechanical and/or electrical connection. In one embodiment, the connector includes a plug and a receptacle. The plug includes a central pin surrounded by a plurality of lamellae. An actuator is positioned about the lamellae for controlling the movement thereof. The receptacle includes a pin housing corresponding to the central pin of the plug. Additionally, the receptacle includes a plurality of receptacle lamellae for interconnection with the plug lamellae. The receptacle may include an actuator for controlling movement of the receptacle lamellae. The plug lamellae and the receptacle lamellae have corresponding shoulders at the ends thereof for interconnecting the plug and the receptacle. The actuators about the plug lamellae and/or receptacle lamellae control movement thereof and can be engaged to allow for the disconnection of the plug and the receptacle. The central pin of the plug and the pin housing of the receptacle can include conductive material for transmitting electrical signals. Similarly, the lamellae can include conductive In another embodiment, a universal connector is provided wherein the plug and receptacle are positioned side by side to provide side by side male and female components. Such a connector can then be interconnected with another similarly configured connector having side by side male and female components to allow for the connection of components to provide a universal connector.

BRIEF DESCRIPTION OF THE DRAWINGS

Other important objects and features of the invention will be apparent from the following Detailed Description of the Invention taken in connection with the accompanying drawings in which.

DETAILED DESCRIPTION OF THE INVENTION

The present invention relates to a connector for mechanically and/or electrically connecting together objects, particularly, modular robotic and electromecanical systems. The connector includes, in one embodiment, male and female components, and in another embodiment, a universal connector with both male and female components positioned side-by-side. The male and female components of the connector interconnect to provide mechanical and electrical connection.

Figure 1:
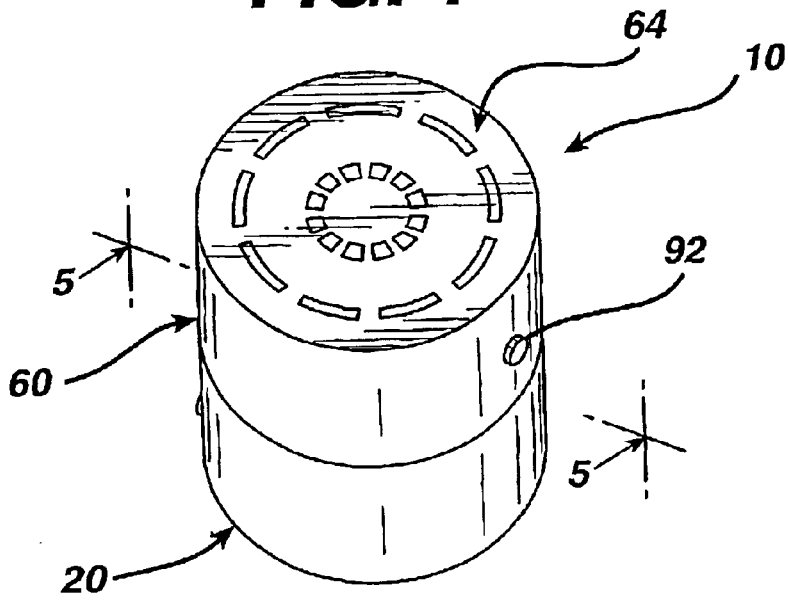
FIG. 1 is a perspective view of the connector shown in a connection position as seen from one end.
Figure 2:
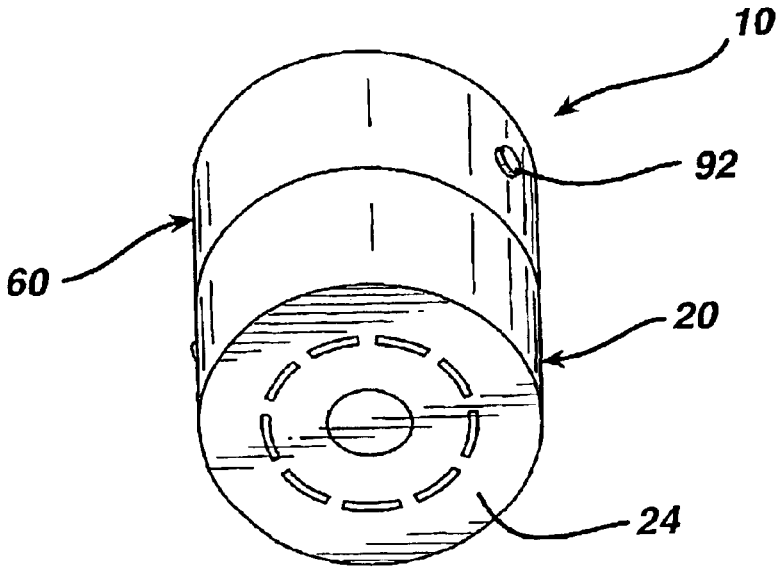
FIG. 2 is a perspective view of the connector shown in FIG. 1 as seen from the opposite end.

Referring to FIGS. 1 and 2, the connector of the present invention, generally indicated at 10, is shown in a connected configuration. The male component, generally indicated at 20, is interconnected with the female component, generally indicated at 60. The top surface 64 of the female component 60 is shown in FIG. 1. The bottom surface 24 of male component 20 is shown in FIG. 2.

Figure 3:
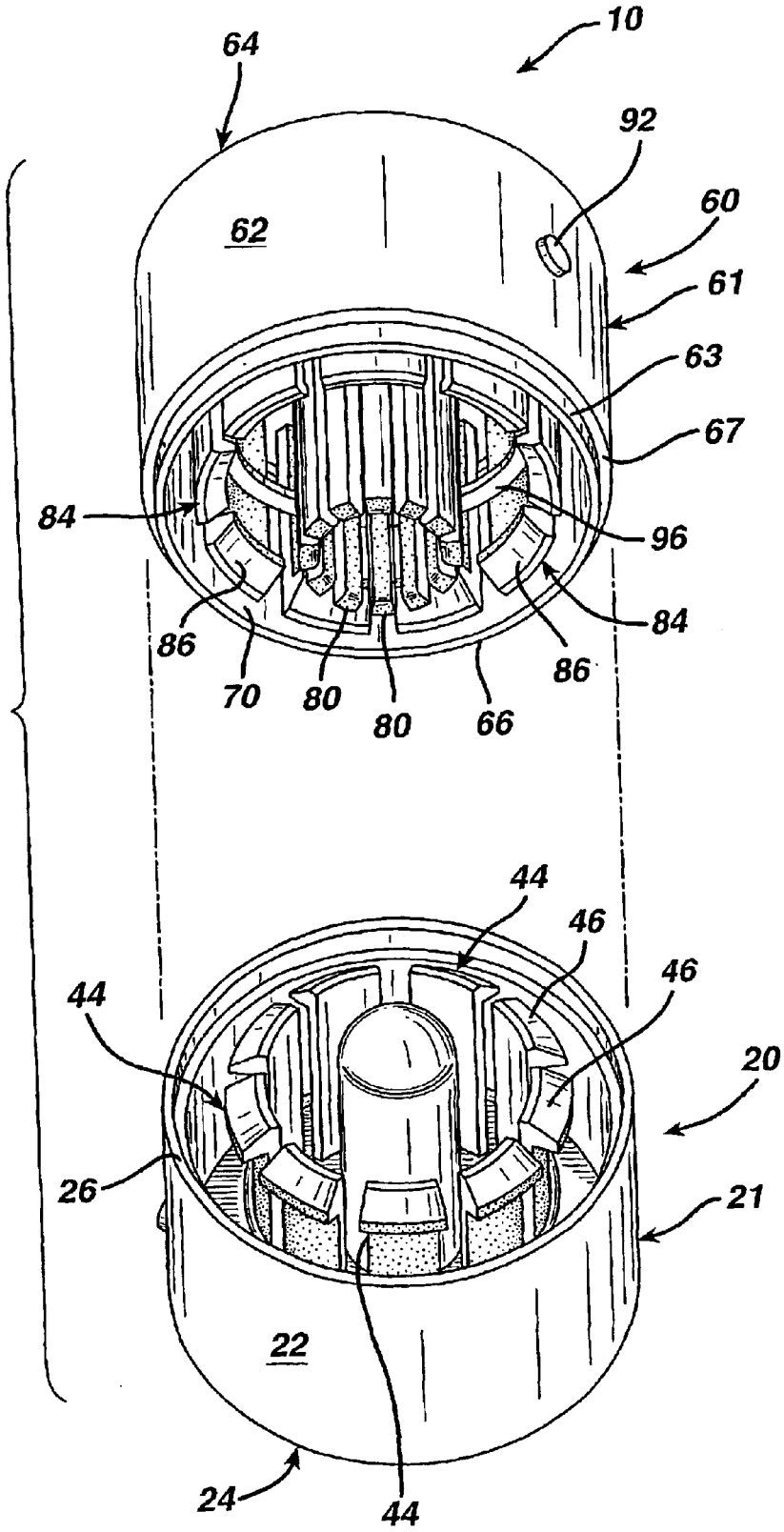
FIG. 3 is an exploded perspective view of the connector shown in FIG. 1 with the plug and receptacle portions disengaged.
Figure 4:
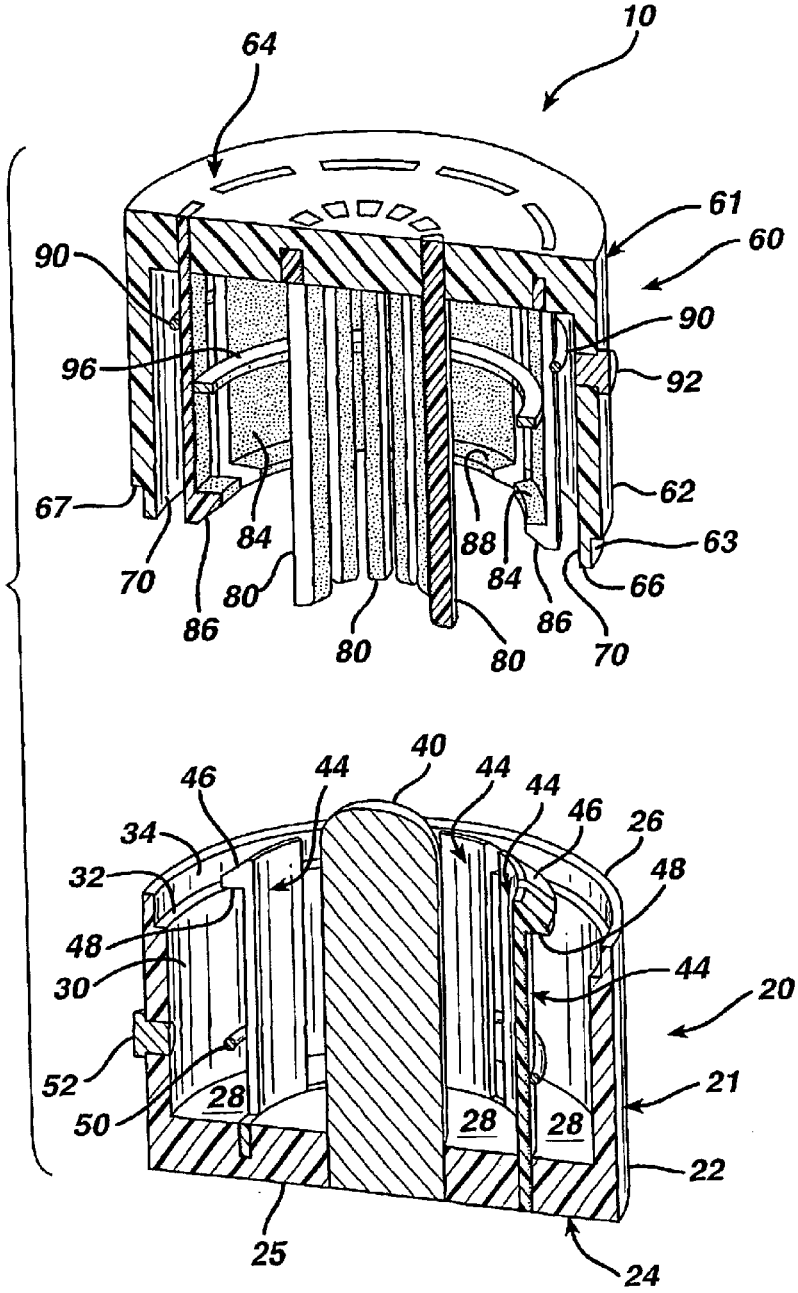
FIG. 4 is an exploded perspective view in partial cross-section of the connector shown in FIG. 3.

Referring now to FIGS. 3 and 4, the male and female components, 20 and 60 respectively, comprising the connector 10 are shown in a disconnected configuration. The male component 20 comprises a housing 21 having a cylindrical outer wall 22 extending from a base 24 having a bottom 25 and an upper surface or floor 28. The cylindrical outer wall 22 includes an upper edge 26 that is stepped down at an inner portion such that the wall has an inner surface 30, a shoulder 32 and an upper inner surface 34. Extending from the base 24 at a central portion thereof is male pin 40. The male pin 40 is positioned to extend along the central axis of the housing 21.

Positioned circumferentially about the male pin 40 are a plurality of male lamellae 44. The male lamellae 44 extend from the base 24, parallel to the male pin 40, and are positioned between the male pin 40 and the housing 21 to form a cylindrical ring about the male pin 40. The male lamellae 44 comprise generally thin flexible strips of a flexible material interconnected at lower ends with the base 24 and having free upper ends. At the free upper ends, the male lamellae 44 include an outwardly sloping face 46 that ends to form shoulder 48. An actuator band 50 extends circumferentially about the male lamellae 44, and a manual actuator button 52 is interconnected with the actuator band 50 and extends can constrict about the male lamellae 44 to move the free ends thereof to allow for disconnecting the connector 10.

Female component 60 includes a housing 61 having a base 64 and a cylindrical outer wall 62 sized and shaped to correspond to the outer wall 22 of the male component 20. A shoulder 67 is formed at an upper end of the outer wall 62 to form an upper outer wall 63. When the female component 60 is connected with the male component 20, the female component shoulder 67 contacts the upper edge 26 of the outer wall 22 of the male component 20 and the lower edge 66 of the cylindrical outer wall 62 of the female component 60 contacts the shoulder 32 of the outer wall 22 of the male component 20.

The housing 61 of female component 60 also includes an inner surface 70 which defines a cylindrical inner space bounded at an upper end by the base 64, having a top end 65. Extending about the axis of the cylindrical wall 62 and interconnected with the base 64 are a plurality of female pins 80 having free upper ends. The female pins 80 are positioned to make contact with the male pin 40 of male component 20 when the male and female components 20 and 60 are engaged.

A plurality of female lamellae 84 are positioned between the inner wall 70 of the housing 61 and the female pins 80 circumferentially about the female pins 80. The female lamellae 84 are interconnected at one end with the base 64 of the female component 60 and having free upper ends. Angled faces 86 are provided at the free upper ends. The angled faces 86 terminate to form shoulders 88. An actuator band 90 is positioned about the lamellae 84 which can be manually actuated by the manual actuator button 92. Additionally, a fulcrum 96 is positioned within the lamellae ring.

Figure 5:
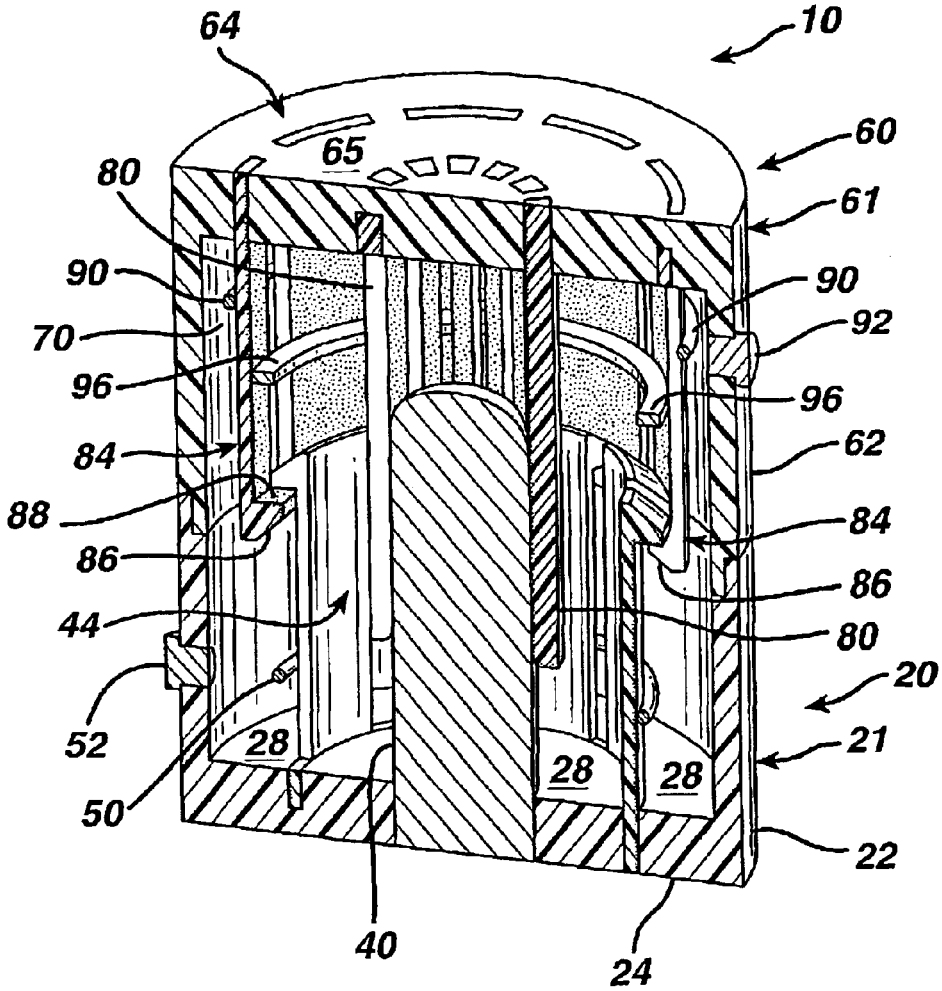
FIG. 5 is a perspective view in partial cross-section of the connector taken along section line 5—5 of FIG. 1.

FIG. 5 shows the male and female connectors 20 and 60 engaged such that the male lamellae 44 engages the female lamellae 84 by the shoulders 48 and 88 being engaged. Additionally, as shown in FIG. 5, the central pin 40 is surrounded by and in contact with the female pins 80. While the lamellae 44 and 84 provide axial resistance to the connector, the contact between the upper inner surface 34 on the plug and upper outer wall 63 on the receptacle provides shear strength to the connector.

Figure 6:
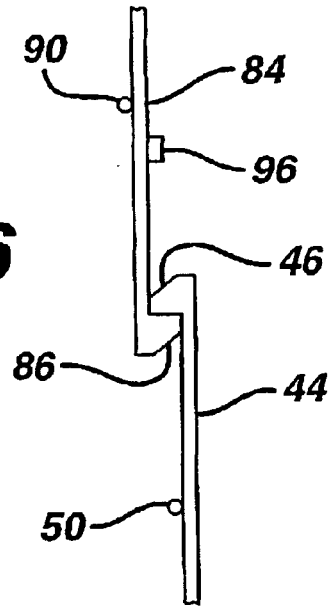
FIGS. 6 and 7 are schematic views of the connector latching means shown in latched and unlatched positions respectively.
Figure 7:
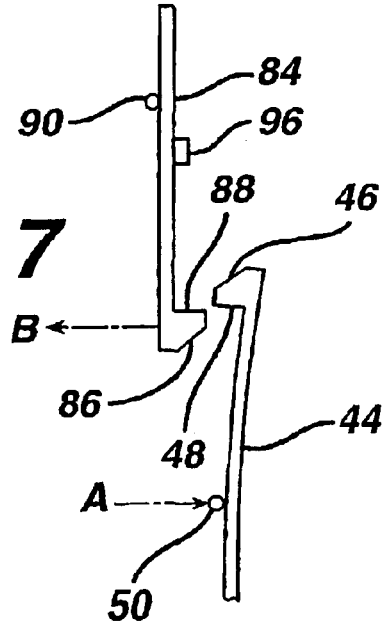

Referring to FIGS. 6 and 7, it can be seen that when the male and female components 20 and 60 are placed together, the male and female lamellae 44 and 84 coact to engage as shown in FIG. 6. During the connecting process, the face 46 of the male lamellae 44 contacts the face 86 of female lamellae 84, and the faces slide against each other to a point where the shoulders 48 and 88, respectively, move past each other and engage. This provides for axial connection of the male and female components 20 and 60. In order to overcome this connection, actuator 50 can be actuated to pull male lamellae 44 in the direction of Arrow A towards the axis of the male connector 20 to disengage male shoulders 48 from female shoulders 88 to allow for the male and female connectors 20 and 40 to be axially separated. Alternatively, actuator 90 can be actuated to move female lamellae 84 against fulcrum 96 to move the free end of lamellae 84 circumferentially away from the axis of the connector in the direction of Arrow B to similarly disengage shoulders 48 and 88 respectively to allow the male and female components 20 and 60 to be axially separated. The present invention could be configured to require movement of both male and female lamellae 44 and 84, or to require movement of either.

In addition to providing mechanical connection, the connector of the present invention can be configured to provide electrical connection. As such, the male pin 40 can be made of a conductive material. The female pin 80 can include conductive materials on inner faces for contacting the male pin 40, but can include non-conductive materials on the outer portions. Likewise, the male and female lamellae 44 and 84 can include conductive material to allow for electrical connection. Importantly, the conductive material would preferably be provided on an outer portion of the male lamellae 44 and correspondingly on an inner portion of the female lamellae 84. As such, the connector can provide electrical communication therethrough over at least two lines. Further lines can be provided by requiring alignment between specific lamellae. Importantly, as can be seen in the figures, specifically FIGS. 1, 2 and 5, the male pin 40 and female pins 80, as well as the male and female lamellae 44 and 84 extend through the base of the male and female components 20 and 60 so that connections are available on the bottom 24 of the male component 20 and on the top 64 of the The actuator bands 50 and 90 are preferably any type of electrostrictive or magnetostrictive materials such as electrostrictive polymers, electromagnetic actuators, piezoelectric actuators, or shape memory alloys. As such, applying a voltage, a magnetic field or other signal to the actuator 50 results in the actuator constricting to move the lamellae 44 or 84. Alternatively, it is within the scope of the present invention to provide actuators that expand to move the lamellae. In either case, the actuators would be positioned proximate the lamellae. Further, manual actuator buttons 52 and 92 can be provided to similarly cause the actuators 50 and 90 to restrict or expand. The buttons 52 and 92 could could send an actuating signal, and/or a mechanical signal move the lamellae 44 and 84 to permit disconnection of the connector in the absence of power. The manual actuator buttons 52 interconnect with and mechanically actuate the actuator bands 50 and 90.

As can be seen from viewing of the drawings and the discussion presented herein, the connectors of the present invention provide mechanical and/or electrical connection. This allows for the connector to transmit axial and shear forces, as well as torque. Additionally, the connectors are self latching in that they merely need to be pushed together and they automatically lock together to make a connection. Additionally, no alignment is necessary between male and female components 20 and 60 and exact alignment is not necessary because the faces 46 and 86 of the male and female lamellae 44 and 84, respectively, assist in alignment of the male and female components 20 and 60 if they are placed in proximity. This allows for blind mating. Further, the connectors can be configured to be disconnected based on a control signal manual or electrical from the male component 20 or the female component 60 or from both. The connector can be varied in terms of dimensions and applicability as desired. Various actuator materials include the following: (1) shape memory alloys, (2) electrostrictive materials, (3) magnetostrictive materials or (4) piezoelectric materials. Other known materials and classical actuators or materials that are hereinafter developed are additionally considered within the scope of the present invention. The angles of the shoulders can be varied to achieve different functions. For example, if the angles of the shoulders are 90 degrees to the However, the shoulders can be angled at an angle greater than 90 degrees which would completely prevent the disconnection without breaking the lamellae. The shoulders could be angled at less than 90 degrees to allow for a specific axial force to disconnect the connector.

Figure 8:
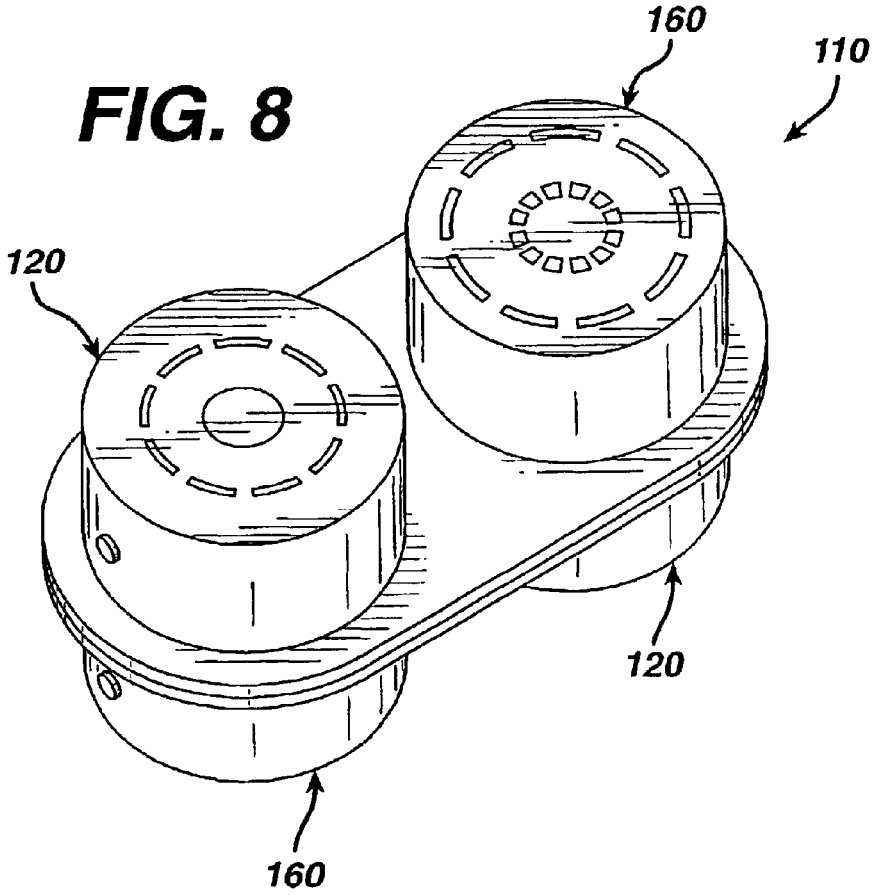
FIG. 8 is a perspective view of an alternate, universal, embodiment of the connector of the present invention shown in a (latched) position.
Figure 9:
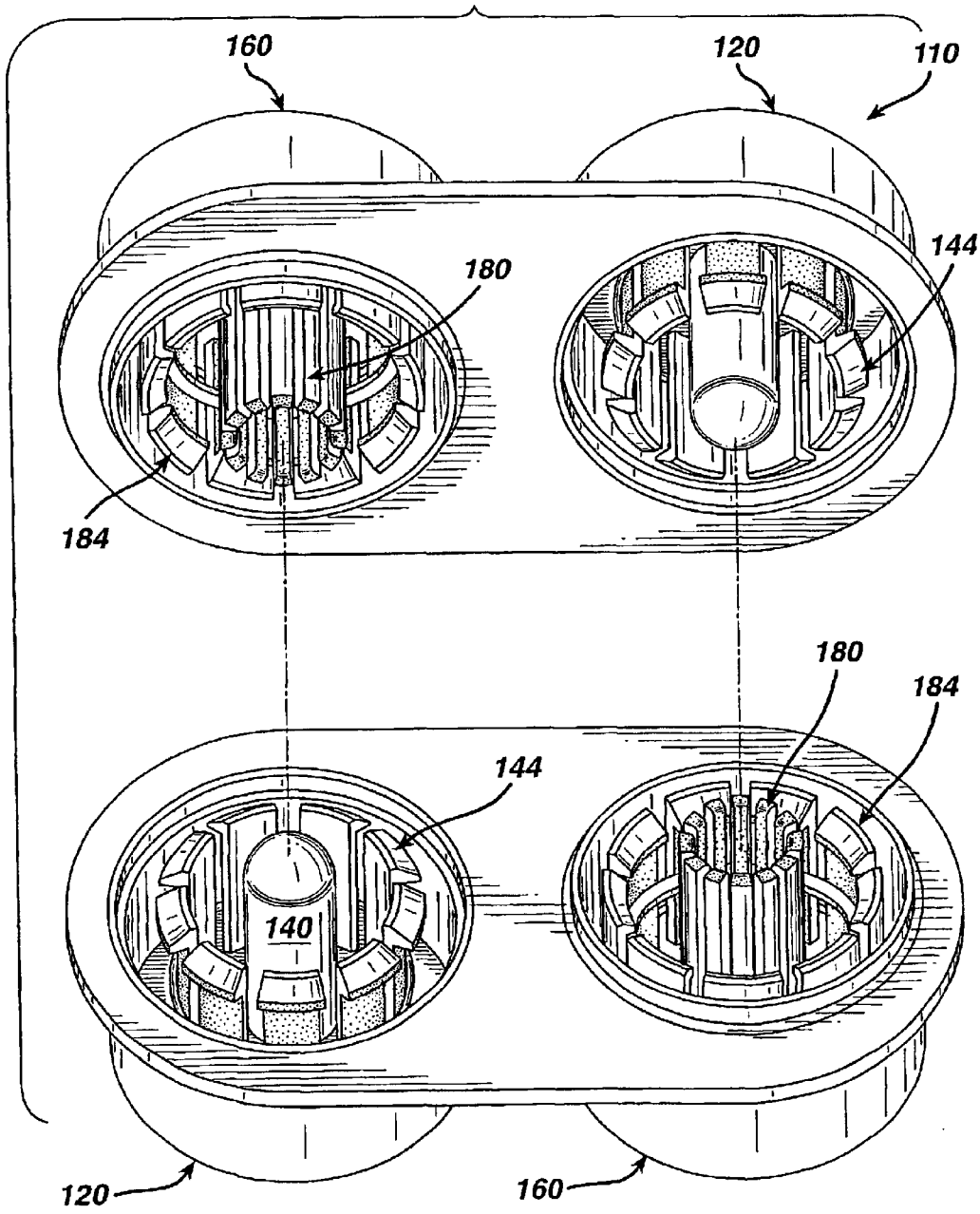
FIG. 9 is an exploded perspective view of the universal connector shown in FIG. 8.

FIGS. 8 and 9 relate to a universal connector according to the present invention wherein an object would include both male and female components, positioned side by side, to allow for the interconnection with another object having male and female components positioned side by side or, alternatively, to either or both of a male or female connector individually. As can be seen in FIG. 8, a male and female component 120 and 160, respectively, are positioned side by side and a corresponding female and male component 160 and 120 are additionally placed side by side such that the sets of male and female components can be simultaneously connected. As shown in FIG. 9, the male component 120 includes a central pin 140 and surrounding lamellae 144. Likewise, each of the female components 160 include a plurality of central pins 180 and surrounding lamellae 184. As with the previous embodiments, the corresponding male and female components 120 and 160 engage to form an electrical and mechanical connection between objects to be connected.

The housing can have different shapes as desired. The connector as presented herein is cylindrical in shape, and has an axial symmetry. However, this can be varied as desired. Importantly, the exterior of the connector is formed of non-conductive materials. The secured ends of the male and female pins and the lamellae are interconnected with the connector housing to allow for electrical conductivity through the connector.

There are many applications for the present invention besides for computer connectors and modular electromechanical systems such as modular robots, as follows:

1) Space and Aerospace Industries: the connector can transmit force, electric signals and can also be designed to connect two pipes or tubes for liquid transfer. It can be useful for attaching objects to an airplane (rockets, radars) or for fuel transfer. For space industry it can be used to connect modules to satellites or space stations.

2) Computer Industry: some cables have to remain locked when connected. For this screws are used. To connect such a cable a human operator is necessary or a specialized automatic tool Using this connector, no specialized intervention is required. Due to the fact that it allows blind mate, a very accurate manipulator is not required.

3) Robot Manufacturers: modular robotics gains more and more space in robotics. To connect two modules special mechanisms or even modules are used. This connector allows automatic assembly and disassembly of such a robot and it can transmit both force (axial force, shear force and torque) and electric signals. No specialized manipulator is necessary to handle the connection and disconnection process—a simple gripper is absolutely sufficient. The disconnection signal can be sent from both sides of the connection (plug and receptacle) and the human intervention is also allowed.

4) Seat-belts for cars: seat belts have a manual mechanical connector/latching mechanism. If this mechanism is connected to the seat through our connector the seat belt can be disconnected automatically by the driver when he/she wants to release it. Usually the children and pets sit on the back seats. In case of an emergency (fire, sinking) the driver may not have the time to release the seat belts for those on the back seats.

5) Seat belts for airplanes. The seat belts have manual connectors. In case of a fire or smoke on-board the passengers may be in panic and not able to disconnect their seat belts. If the disconnection can be done from the cockpit for all the passengers that can save some lives. This can easily be done if one end of the seat belt is connect to the seat through this connector.

Having thus described the invention in detail, it is to be understood that the foregoing description is not intended to limit the spirit and scope thereof what is desired to be protected by letters patent is set forth in the appended claims.

What is claimed is:

1. A connector apparatus comprising:

a plug component having a housing with a plug base at one end;

a central pin extending from the plug base of the housing;

a plurality of lamellae interconnected with the plug base and positioned about the central pin, the lamellae having angled faces at the upper free ends and shoulders;

a receptacle component having a housing with a receptacle base;

a plurality of receptacle pins extending from the receptacle base, positioned to coact with the central pin;

a plurality of lamellae extending from the receptacle base and positioned about the receptacle pins, the lamellae having upper free ends with faces and shoulders;

a receptacle actuator band positioned proximate to the receptacle lamellae;

a fulcrum positioned proximate the receptacle lamellae between the actuator band and the free ends of receptacle lamellae;

a plug actuator band extending about the plug lamnellae for moving the plug lamellae away from the receptacle lamellae to allow for disengagement of the connector;

wherein, when the plug and receptacle are positioned together, the faces of the plug and receptacle lamellae coact to urge the shoulders of the plug and receptacle lamellae into engagement to connect the plug and the receptacle; and when the plug actuator band is actuated, the plug lamellae are moved away from the receptacle lamellae and when the receptacle actuator band is actuated, the receptacle lamellae are urged against the fulcrum to move the free ends of the receptacle lamellae away from the plus lamellae to allow for disengagement of the connector.

2. The apparatus of claim 1 wherein the actuator band is actuated by an electric signal delivered to the actuator band.

3. The apparatus of claim 1 wherein the actuator band is actuated by a mechanical signal delivered to the actuator band.

4. The apparatus of claim 1 wherein the actuator band is actuated by a thermal signal delivered to the actuator band.

5. The apparatus of claim 1 further comprising an actuating button interconnected with the actuator band for sending a signal to actuate the actuator band to disengage the connector.

6. The apparatus of claim 1 wherein the actuator band comprises an electrostrictive material.

7. The apparatus of claim 1 wherein the actuator band comprises a magnetorestrictive material.

8. The apparatus of claim 1 wherein the actuator band comprises a piezoelectric material.

9. The apparatus of claim 1 wherein the actuator band comprises a shape memory alloy material.

10. The apparatus of claim 1 wherein the receptacle actuator band is actuated by an electric signal delivered to the receptacle actuator band.

11. The apparatus of claim 1 wherein the receptacle actuator band is actuated by a mechanical signal delivered to the receptacle actuator band.

12. The apparatus of claim 1 wherein the receptacle actuator band is actuated by a thermal signal delivered to the receptacle actuator band.

13. The apparatus of claim 1 further comprising a receptacle actuating button interconnected with the receptacle actuator band for mechanically, manually actuating the receptacle actuator band.

14. The apparatus of claim 1 wherein the receptacle actuator band comprises an electrostrictive material.

15. The apparatus of claim 1 wherein the receptacle actuator band comprises a magnetorestrictive material.

16. The apparatus of claim 1 wherein the receptacle actuator band comprises a piezoelectric material.

17. The apparatus of claim 1 wherein the receptacle actuator band comprises a shape memory alloy material.

18. The apparatus of claim 1 wherein the plug and receptacle components are cylindrical.

19. The apparatus of claim 1 wherein the position of the plug actuator band with respect to the length of the plug lamellae provides for sufficient displacement of the free ends of the plug lamellae to disengage same from the receptacle lamellae.

20. The apparatus of claim 1 wherein the position of the receptacle actuator band with respect to the length of the receptacle lamellae and the position of the fulcrum provides for sufficient displacement of the free ends of the receptacle lamellae to disengage same from the plug lamellae.

21. The apparatus of claim 1 further comprising an actuating button interconnected with the actuator band for mechanically, manually actuating the actuator band.

22. The apparatus of claim 6 wherein the actuating button additionally mechanically actuates the actuator band.

23. The apparatus of claim 1 further comprising a receptacle actuating button interconnected with the receptacle actuator band for sending a signal to actuate the receptacle actuator band to disengage the connector.

24. The apparatus of claim 23 wherein the receptacle actuating button additionally mechanically actuates the receptacle actuator band.

25. A method of connecting objects comprising:

providing a plug on one object, the plug including a central pin, a plug connecting ring positioned thereabout, and a plug housing positioned thereabout, the plug connecting ring comprising a plurality of plus fingers extending from a base of the plug receptacle to a free end, the free end including outwardly angled faces and outwardly facing shoulders thereunder, the central pin including a rounded forward surface to self align the central pin of the plus with the central pin receptacle of the receptacle;

providing a receptacle on another object, the receptacle including a central pin receptacle, a receptacle connector ring and a receptacle housing thereabout, the receptacle connector ring comprising a plurality of receptacle fingers extending from a receptacle base to a free end, the free ends including inwardly angled faces and inwardly facing shoulders;

moving the plug and receptacle together;

allowing the central pin to enter the central pin receptacle;

allowing the plug connector ring and the receptacle connector ring to engage; and allowing the plug and receptacle housings to engage;

wherein exact alignment of the plug and receptacle are not necessary for engagement as the central pin seats itself in the central pin receptacle as the plug and receptacle are moved together and the angled faces of the plug fingers and receptacle fingers bear against each other to move the fingers away from each other to allow the shoulders to move past each other and engage.

26. The method of claim 25 further comprising transmitting an electric signal through the connector comprising providing an electrical conductor on the exterior of the central pin and providing a corresponding electrical conductor on the interior of the pin receptacle, the conductors extending through the plug and receptacle bases to allow an electrical signal to travel therethrough.

27. The method of claim 26 further comprising providing electrical conductors on the exterior of the plug fingers and the interior of the receptacle fingers and extending the contacts through the plug and receptacle bases to transmit an electrical signal through the conductor.

28. The method of claim 27 further comprising the step of disengaging the connector by transmitting a signal to an actuator band about the plug fingers to move the plug fingers with respect to the receptacle fingers.

29. The method of claim 28 further comprising disconnecting the connector by moving the receptacle fingers outwardly with respect to the plug fingers by moving the receptacle fingers against a fulcrum to spread the receptacle fingers.

30. The method of claim 29 wherein the plug fingers can be moved manually by actuating a plug actuator button to manually move the plug fingers.

31. The method of claim 30 further comprising the step of manually moving the receptacle fingers by actuating a receptacle actuator button to move the receptacle fingers.

32. The method of claim 31 further comprising forming a universal connector by positioning plugs and receptacles together on an object.

* * * * *

UNITED STATES PATENT AND TRADEMARK OFFICE

CERTIFICATE OF CORRECTION

PATENT NO. : 6,780,042 B1
DATED : August 24, 2004
INVENTOR(S) : Mircea Badescu and Constantinos Mavroidis It is certified that error appears in the above-identified patent and that said Letters Patent is hereby corrected as shown below:

Column 7,
Line 64, delete the word “plus” and replace with -- plug --.

Column 8,
Line 54, delete “6” and replace with -- 5 --.
Line 67, delete the word “plus” and replace with -- plug --.

Column 9,
Line 5, delete the word “plus” and replace with -- plug --.

Signed and Sealed this

Fourteenth Day of December, 2004

JON W. DUDAS
*Director of the United States Patent and Trademark Office*